United States Patent [19]

Erasov et al.

[11] 4,451,216

[45] May 29, 1984

[54] PLANETARY HYDRAULIC MOTOR WITH STATOR GEAR HINGED TO A HOUSING

[75] Inventors: Fedor N. Erasov, Odessa; Boris A. Chumachenko; Vladimir M. Potaichuk, both of Zaporozhie, all of U.S.S.R.

[73] Assignee: Zaporozhsky Konstruktorsko-Tekhnologichesky Institut Selskokhozyaistvennogo Mashinostroenia, Zaporozhie, U.S.S.R.

[21] Appl. No.: 355,544

[22] PCT Filed: May 29, 1981

[86] PCT No.: PCT/SU81/00047

§ 371 Date: Feb. 23, 1982

§ 102(e) Date: Feb. 23, 1982

[87] PCT Pub. No.: WO82/00173

PCT Pub. Date: Jan. 21, 1982

[30] Foreign Application Priority Data

Jul. 8, 1980 [SU] U.S.S.R. ..... 2952646

[51] Int. Cl.[3] ..... F03C 2/00

[52] U.S. Cl. ..... 418/61 B; 418/186

[58] Field of Search ..... 418/61 B, 186

[56] References Cited

U.S. PATENT DOCUMENTS 3,910,732 10/1975 Lusztig ..... 418/61 B

FOREIGN PATENT DOCUMENTS 2844844 4/1980 Fed. Rep. of Germany .
2190152 1/1974 France .
574562 4/1976 Switzerland .
1307015 2/1973 United Kingdom .
205567 11/1967 U.S.S.R. .
389288 7/1973 U.S.S.R. .
595536 2/1978 U.S.S.R. .
696179 11/1979 U.S.S.R. .

*Primary Examiner*—John J. Vrablik
*Attorney, Agent, or Firm*—Ladas & Parry

[57] ABSTRACT

A planetary hydraulic motor comprises a stator gear (1) having arranged inside thereof a rotor (3), and cover plates (5 and 6) adjacent to end faces of the rotor (3) and the stator gear (1). Rigidly secured to the stator gear (1) is one end of an arm (7) the other end of which is secured by means of a hinged joint to a housing (9) of an actuating mechanism, the rotor (3) being mounted directly on a drive shaft (10) of the actuating mechanism.

1 Claim, 2 Drawing Figures

PLANETARY HYDRAULIC MOTOR WITH STATOR GEAR HINGED TO A HOUSING

FIELD OF THE INVENTION

This invention relates to hydraulic positive displacement devices, and more particularly to planetary hydraulic motors.

Background of the Invention

There is known a planetary hydraulic motor (cf. USSR Inventor's Certificate No. 595,536; IPC F04C 1/00; published in the Bulletin "Discoveries, Inventions, Industrial Designs and Trademarks" No. 8, 1978)—in Russian comprising a stator gear having eccentrically arranged therein a rotor connected by means of a universal joint with an output shaft. Attached to the stator gear are two cover plates: one for mounting the planetary hydraulic motor and one for feeding a working fluid.

The use of the universal joint for converting compound motions of the rotor into rotation of the output shaft reduces the reliability and increases the dimensions of the above planetary hydraulic motor.

Another planetary hydraulic motor is known bearing closest resemblance to the one to described in this specification (cf. USSR Inventor's Certificate No. 389,288; IPC F04C 1/00; published in the Bulletin "Discoveries, Inventions, Industrial Designs and Trademarks", No. 29, 1973, p. 130—in Russian). This motor comprises a stator gear having interior teeth. Inside the stator gear is mounted eccentrically a ring rotor having exterior teeth; the motor also has cover plates adjoining end faces of the ring rotor and the stator gear.

This planetary hydraulic motor also employs a universal joint for transmitting the motions of the rotor to the shaft of a working implement. Such a transmission of the orbiting motions of the ring rotor to the shaft of the working implement by means of the universal joint is likewise disadvantageous in that the motor becomes complicated and oversized. It also is not reliable or durable enough.

SUMMARY OF THE INVENTION

The invention is directed toward the provision of a planetary hydraulic motor having a much simplified means for converting a compound cooperation of a rotor and stator gear into a concentric rotational motion of a shaft of a working implement by directly connecting the rotor with such a shaft.

The invention provides for reducing the overall dimensions and weight of the rotary hydraulic motor, as well as makes it structurally simpler, improves its reliability and extends its life.

BRIEF DESCRIPTION OF THE DRAWINGS

The invention will now be described in greater detail with reference to specific embodiments thereof taken in conjunction with the accompanying drawings, in which.

BEST MODE OF CARRYING OUT THE INVENTION

Figure 1:
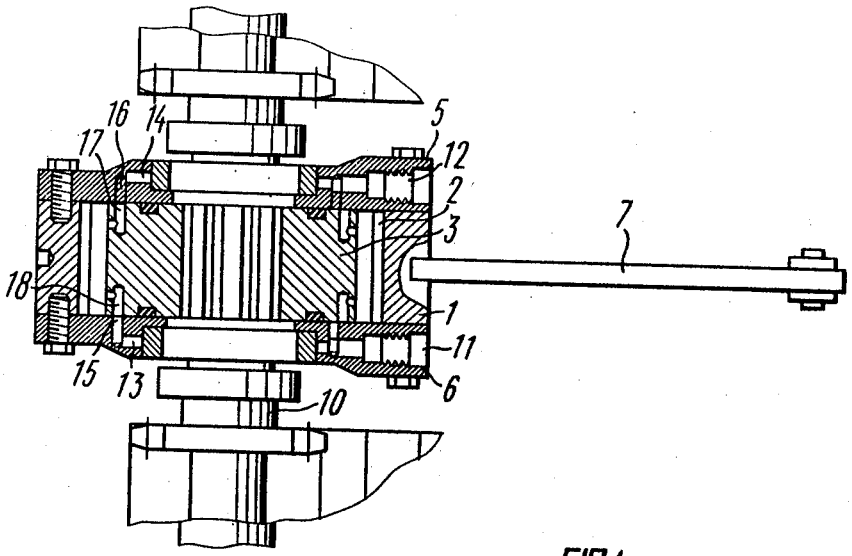
FIG. 1 is a longitudinal sectional view of a planetary hydraulic motor according to the invention.
Figure 2:
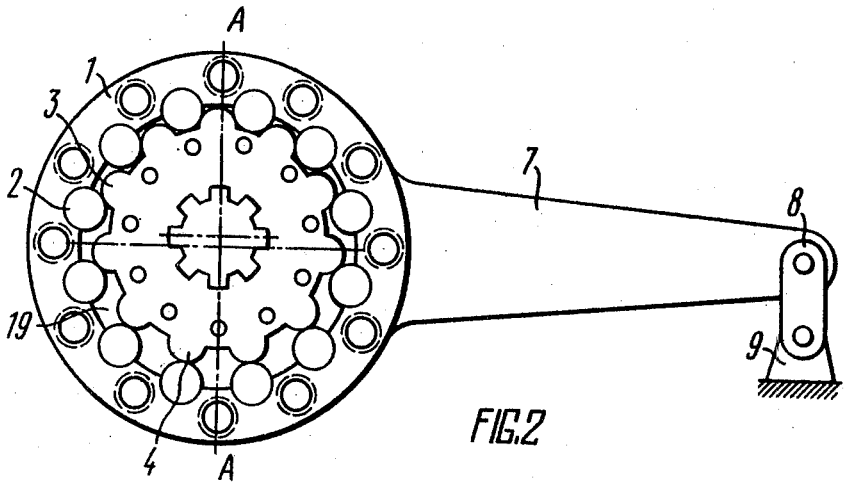
FIG. 2 is a side view of the planetary hydraulic motor according to the invention with a cover plate removed.

A planetary hydraulic motor comprises a stator gear 1 (FIG. 1) having interior teeth 2. Mounted eccentrically inside the stator gear 1 is a rotor 3 having exterior teeth 4 (FIG. 2). Also provided are cover plates 5 and 6 (FIG. 1) adjacent to end faces of the rotor 3 and those of the stator gear 1. Fixedly secured to the stator gear 1 is one end of an arm 7, the other end of which is connected by means of a hinged joint 8 (FIG. 2) to a housing 9 of an actuating mechanism (not shown). The rotor 3 (FIG. 1) is mounted directly on a drive shaft 10 of the actuating mechanism. The cover plates 5 and 6 are provided with passageways 11 and 12 for feeding and discharging a working fluid, annular chambers 13 and 14, and axial passages 15 and 16. The rotor 3 also has axial passages 17 and 18 communicating with its interteeth space. The interteeth space of the rotor 3 and the stator gear 1 define working chambers 19 (FIG. 2) of variable volume.

The planetary hydraulic motor operates in the following manner.

The working fluid fed through the passageway 11 (FIG. 1) into the chambers 13 enters via the axial passages 18 of the rotor 3 one half of the working chambers 19 (FIG. 2) on the one side of the symmetry plane AA. Under the action of the pressure of the working fluid in these chambers, the stator gear 1 is caused to orbit around the rotor 3 thereby transmitting rotational motion thereto. The working fluid passes through the axial passages 17 (FIG. 1) of the rotor 3 and the axial passages 16 of the cover plate 5 into the annular chamber 14 and goes further via the outlet passageway 12 for discharge.

During operation of the planetary hydraulic motor the stator gear 1 thereof executes oscillatory orbital movements.

The torque produced by the planetary hydraulic motor is then transmitted to the shaft 10 of the actuating mechanism by way of the rotor 3 mounted directly on this shaft 10, whereas the stator gear is prevented from rotation by the arm 7 enabling the stator gear 1 to move only radially relative to the rotor 3.

INDUSTRIAL APPLICABILITY

The planetary motor can find most efficient application in heavy machine building and shipbuilding industries for producing high torques at a low shaft rpm, for example, for rotating the shafts of conveyers or for turning ship rudders.

We claim:

1. A planetary hydraulic motor comprising a stator gear having interior teeth, a rotor mounted eccentrically inside said stator gear and having exterior teeth, said rotor being mounted directly on a drive shaft of an actuating mechanism and having passages communicating with spaces between said interior and said exterior teeth, said spaces defining working chambers of variable volume, cover plates adjacent to end faces of said rotor and said stator gears and provided with passageways for feeding and discharging a working fluid through said rotor passages, and an arm fixedly secured at one end to said stator gear and at an other end to a housing of said actuating mechanism.

* * * * *